US005924939A

United States Patent [19]

Grace et al.

[11] Patent Number: 5,924,939

[45] Date of Patent: Jul. 20, 1999

[54] GOLF CLUB HEAD WITH A STRIKE FACE HAVING A FIRST INSERT WITHIN A SECOND INSERT

[75] Inventors: Robert M. Grace, Clearwater, Fla.; Lauro C. Cadorniga, Piedmont, S.C.; Harold Max Parker, Jr.; William E. Bartlett, both of St. Petersburg, Fla.

[73] Assignee: Cobra Golf Incorporated, Carlsbad, Calif.

[21] Appl. No.: 09/001,812

[22] Filed: Dec. 31, 1997

Related U.S. Application Data

[63] Continuation-in-part of application No. 08/711,974, Sep. 10, 1996.

[51] Int. Cl.[6] ..... A63B 53/04

[52] U.S. Cl. ..... 473/324; 473/330; 473/409; 473/342

[58] Field of Search ..... 473/313, 251, 473/342, 328, 324, 236, 253, 340, 349, 325, 329, 332, 409, 330, 331; 273/DIG. 14

[56] References Cited

U.S. PATENT DOCUMENTS

| | | | |
|---|---|---|---|
| 2,846,228 | 8/1958 | Reach . | |
| 2,880,002 | 3/1959 | Wetty . | |
| 3,749,408 | 7/1973 | Mills . | |
| 3,836,153 | 9/1974 | Dance . | |
| 3,989,248 | 11/1976 | Campau . | |
| 4,679,792 | 7/1987 | Straza . | |
| 4,804,188 | 2/1989 | McKee . | |
| 4,809,978 | 3/1989 | Yamaguchi . | |
| 5,104,457 | 4/1992 | Viljoen . | |
| 5,332,214 | 7/1994 | Tucker . | |
| 5,333,861 | 8/1994 | Mills . | |
| 5,358,249 | 10/1994 | Mendralla . | |
| 5,362,055 | 11/1994 | Rennie . | |
| 5,411,264 | 5/1995 | Oku . | |
| 5,431,396 | 7/1995 | Shieh . | |
| 5,447,311 | 9/1995 | Viollaz . | |
| 5,458,332 | 10/1995 | Fisher | 473/342 |
| 5,460,377 | 10/1995 | Schmidt | 473/342 |
| 5,529,543 | 6/1996 | Beaumont . | |
| 5,588,923 | 12/1996 | Schmidt . | |
| 5,605,510 | 2/1997 | Schmidt | 473/342 |
| 5,605,511 | 2/1997 | Schmidt . | |
| 5,674,132 | 10/1997 | Fisher . | |

*Primary Examiner*—Sebastiano Passaniti
*Attorney, Agent, or Firm*—Pennie & Edmonds LLP

[57] ABSTRACT

A golf club head having two layers of differently colored, material. One layer is molded with projections, and the other with corresponding recesses, into which the projections fit and are visible from the front strike face of the insert.

15 Claims, 3 Drawing Sheets

GOLF CLUB HEAD WITH A STRIKE FACE HAVING A FIRST INSERT WITHIN A SECOND INSERT

RELATED APPLICATIONS

This application is a continuation in part of co-pending application Ser. No. 08/711,974, filed Sep. 10, 1996 and entitled "Rubber Composition for Golf Putter Face Insert and Golf Putter Comprising said Rubber Insert".

BACKGROUND OF THE INVENTION

In recent years, golf club technology has evolved rapidly, with many different types of materials, including wood, composite materials, and various metals, now being used to manufacture golf clubs. Golf ball technology has also evolved from the early balata construction to a variety of new golf balls of different materials and designs, including a popular two-piece construction.

With the advent of new golf balls, golf clubs have evolved to provide a feel and sound to the club when striking the ball, such as a two-piece ball, that emulates the feel and sound of striking a balata ball. Along these lines, golf putter manufacturers have introduced putter inserts designed and marketed to appeal to golfers for their soft feel and sound. However, these putter inserts generally do not allow for logos or other indicia to be practically, and prominently, displayed thereon.

Where the prior art club heads do include inserts with indicia, they are typically formed by employing a transparent layer of insert material covering the indicia. Structures of this type are disclosed, for example, in U.S. Pat. Nos. 5,460,377 and 5,605,510. A problem with prior art insert structures of the type described above is that the strike face of the insert is hard and does not provide a soft feel and sound for good playability, as especially desirable with putters.

SUMMARY OF THE INVENTION

It is an object of the present invention to provide a golf club strike face having an insert constructed of a material providing a soft feel and at the same time permitting the inclusion of a logo or other indicia which is prominently visible on the putter face.

In accordance with the invention, the golf club and more particularly the face of the club head of a putter is provided with an insert constructed of two layers of differently colored material. One layer contains projections extending into the other layer. The projections on the one layer form a logo or other indicia and are visible at the strike face of the insert. In the preferred embodiment, the one layer is molded with the projections and the second layer is separately molded with recesses for receiving the projections, so that when combined, the two layers fit snugly together. The insert is then adhered to the putter face and the front surface of the second layer of the insert is machined so that the projections of the underlying layer are visible at the machined surface. The projections of the underlying layer are ideally formed as a logo or other indicia, and appears prominently on the putter face, as an integral part of the insert.

The invention is particularly applicable to inserts made of material which is opaque and which, at the same time, has the physical properties to provide the soft feel and sound, preferred by golfers.

DETAILED DESCRIPTION OF THE INVENTION

The following embodiment of the present invention will be described in the context of golf putters having strike face inserts, although those skilled in the art will recognize that the disclosed method and structure are usable with other golf clubs.

Figure 1:
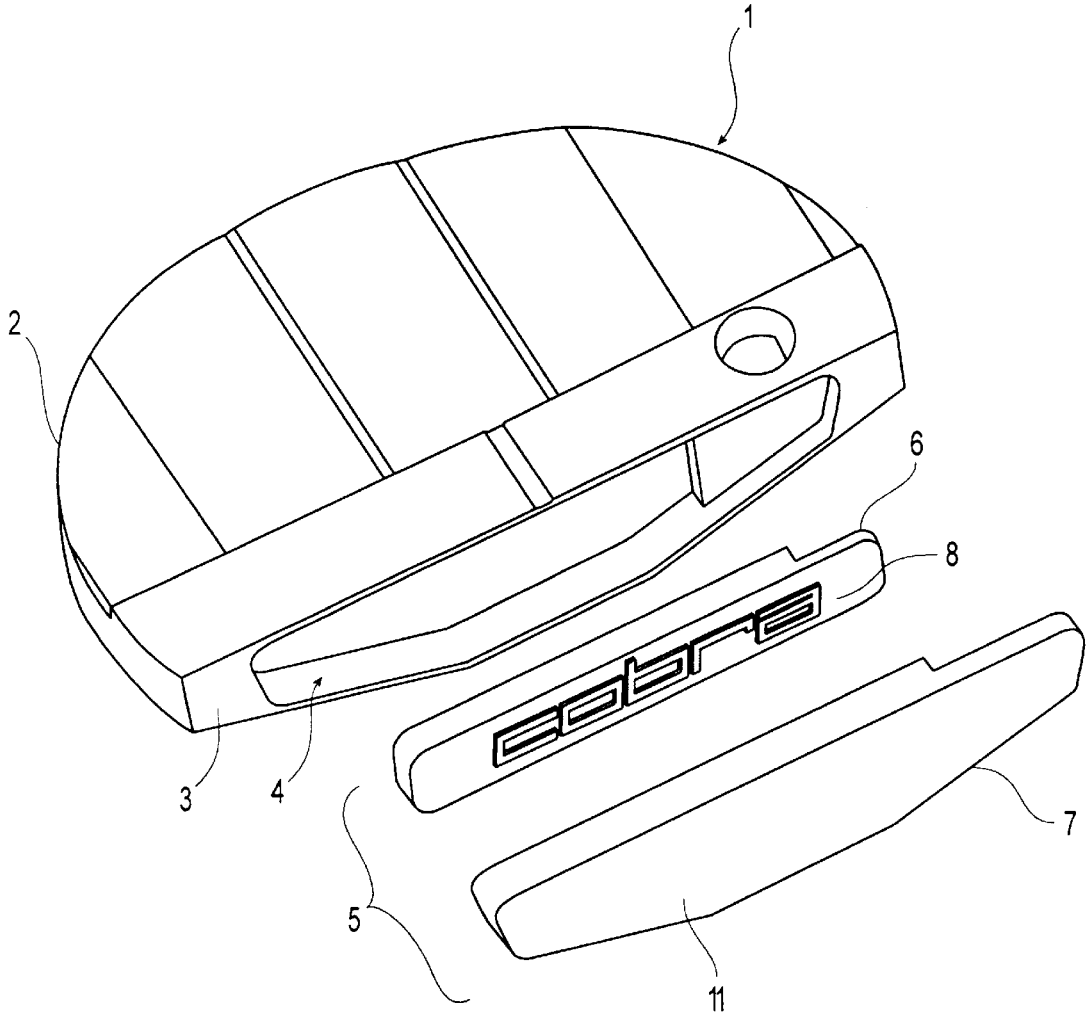
FIG. 1 is an exploded front perspective view a golf club putter head having an insert according to the invention.
Figure 2:
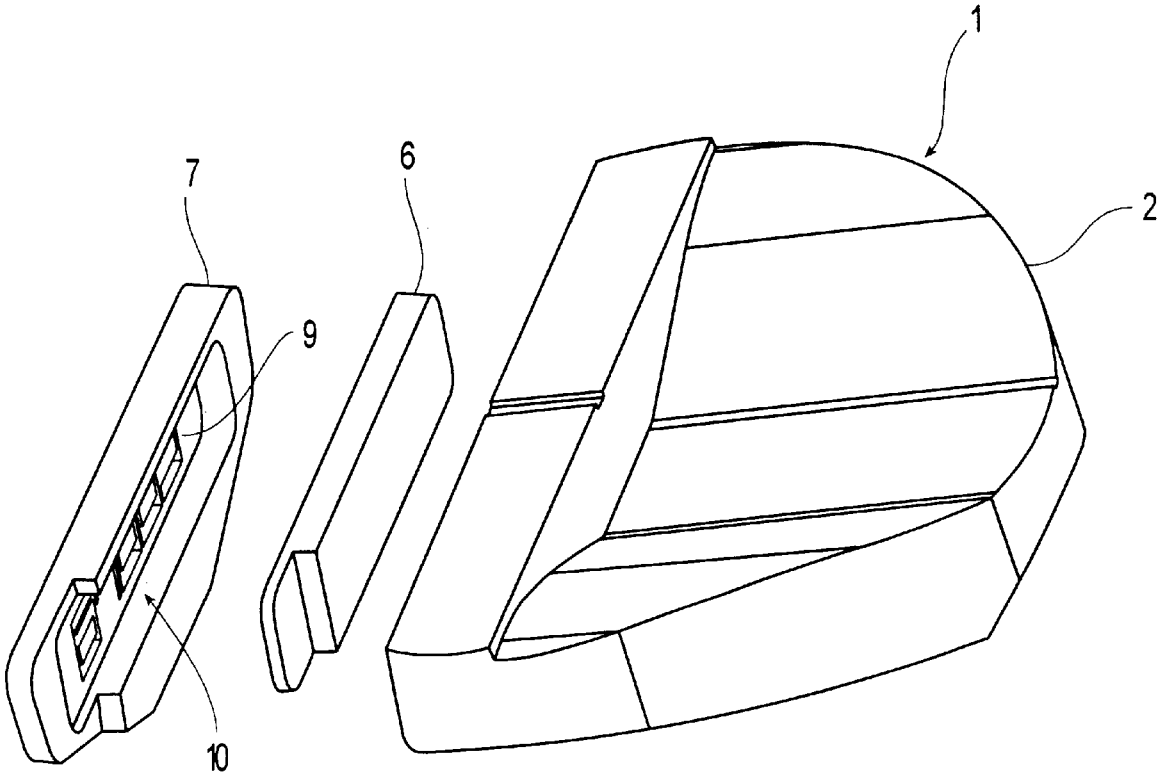
FIG. 2 is an exploded rear perspective view of the putter head of FIG. 1.
Figure 3:
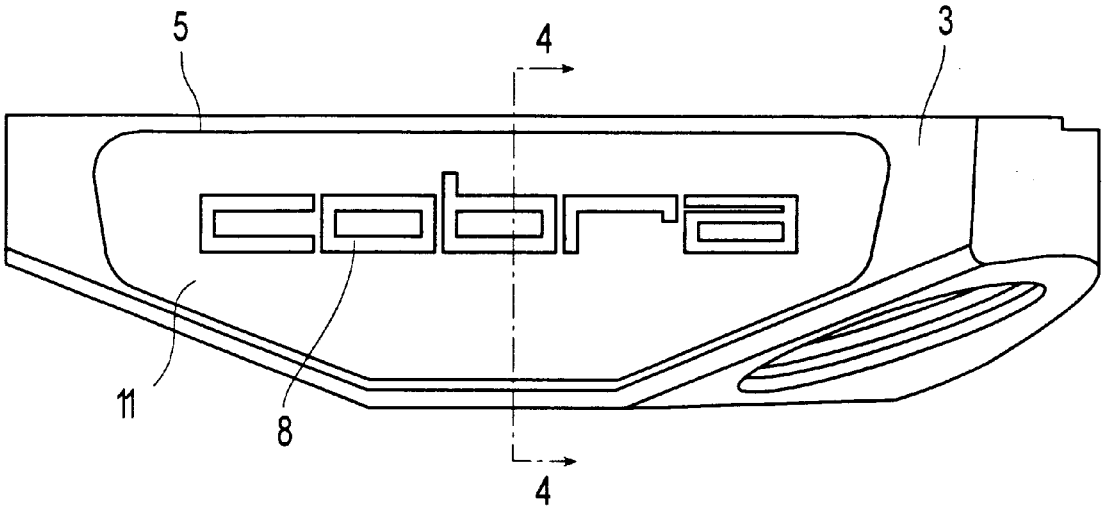
FIG. 3 is a front view of the putter head constructed according to the invention.

As shown in FIG. 1, putter head 1 includes a body 2, having a front strike face 3, a strike face cavity 4, and a strike face insert 5. The strike face insert includes a first layer 6 and a second layer 7. In FIG. 1, the putter head body is shown as having a mallet shape with a particularly shaped insert. It is to be understood, however, that other shapes for the body and insert are usable.

In accordance with the teachings of the present invention, the two layers 6 and 7 of the strike face insert are composed of differently colored materials. In the preferred embodiment, the materials are the same except for color, so as to provide for a consistent sound and feel when striking a golf ball. The materials are opaque and of contrasting colors so that logos or other indicia may be displayed on the strike face of the putter. Suitable materials for layers 6 and 7 include, but are not limited to, those disclosed in applicants' parent application, identified above, the disclosure of which is incorporated herein by reference. Preferably, the insert material is a thermoset rubber, as for example, one formed of a cured mixture comprising a polymer blend, a metal salt of an unsaturated carboxylic acid, a free radical indicator, and silica.

In manufacturing the insert 5, layer 6 is molded with projections 8, and the layer 7 with corresponding recesses 9. Insert layer 7 defines a large recess 10 shaped to receive and hold insert layer 6. The recesses 9 are formed within recess 10.

The assembled insert layers form the putter strike face insert 5 with a front strike face 11 defined by the front surface of the insert layer 7.

In the preferred embodiment, the insert layers 6 and 7 are separately molded from uncured stock material. The molding is effected by taking a block of uncured material and curing it under heat and pressure in a mold cavity having the desired shape of the insert layer. The same procedure is followed for forming both insert layers. After the insert layers have been formed, they are fit together, preferably with a suitable glue.

Alternatively, one of the insert layers, as for example, the layer 7 with the recesses 9 and 10 is formed by curing, under heat and pressure, a block of uncured material, in an appropriately shaped cavity. This formed insert layer is then used as part of the molding cavity for forming the other insert layer. Thus the second insert layer is formed while it is simultaneously fit to the first insert layer. This procedure eliminates the need to separately fit and glue the two insert layers together.

Figure 4:
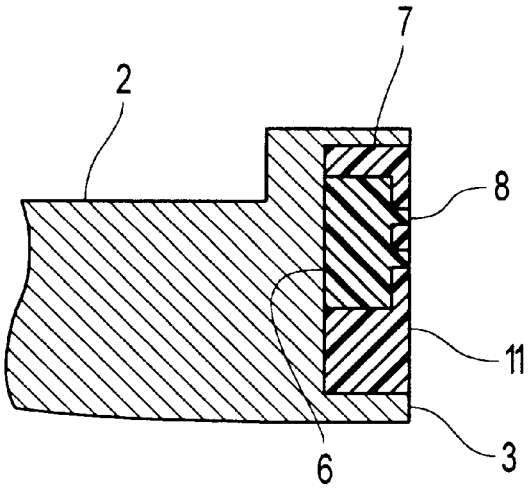
FIG. 4 is a cross-sectional view taken along lines 4—4 of FIG. 3.

After the insert layers are molded and fit together, the resulting insert is then fit within the recess 4 with the front strike face 11 of the insert and the projections 8 of the insert layer 6 extending beyond the strike face 3 of the putter body 2 (FIG. 4). The front strike face 10 of the insert is then machined until it is flush with the strike face 3 of the club head body. Enough of the opaque material of the insert layer 7 is removed to expose the projections 8 of underlying insert layer 6, whereby the projections of contrasting color become visible and distinguishable at the machined front strike face of the insert.

With the present invention, the putter head is provided with an improved insert strike face that includes permanent, integral indicia that will not wear off. Further, since the material of both insert layers is the same, performance will be the same as with a single insert.

What is claimed is:

1. A golf club head, comprising:

a) a body having a front strike surface and a cavity therein; and b) a strike face insert secured within the cavity and including a first layer and a second layer of insert material, said first layer having projections formed as predetermined indicia extending into said second layer and visible and distinguishable at the front strike face of said body.

2. The golf club head of claim 1 wherein:

a) said insert has a front strike face; and b) the projections on said first layer are flush with said front strike face of the insert.

3. The golf club head of claim 2 wherein:

a) the second layer includes a machined surface defining said front strike face of the insert, said machined surface being flush with the front strike surface of the club head body.

4. The golf club head of claim 3 wherein:

a) said first layer is adhesively secured to said second layer.

5. The golf club head of claim 3, wherein:

a) said first layer comprises a first colored opaque material and said second layer comprises a second colored opaque material.

6. The golf club head of claim 5, wherein:

a) said first colored material and said second colored material are identical in all respects except color.

7. The golf club head of claim 6, wherein:

a) said strike face insert material comprises thermoset rubber.

8. The golf club head of claim 7, wherein:

a) said strike face insert is a cured mixture comprising a polymer blend, a metal salt of an unsaturated carboxylic acid, a free radical indicator, and silica.

9. A method of making a golf club head body having a front strike face, a strike face cavity, and a strike face insert, comprising the steps of:

a) forming a first insert layer with projections formed as predetermined indicia;

b) forming a second insert layer with recesses corresponding to the projections of said first insert layer;

c) fitting said first insert layer to said second insert layer with said projections fitting within said recesses to form said strike face insert; and d) fitting said strike face insert in the strike face cavity of the golf club head body.

10. The method of claim 9, wherein the second insert layer has a front surface defining the front strike face of the insert, the method further comprising the step of:

a) locating the projections of said first insert layer relative to the front surface of said second insert layer whereby said projections are exposed and visible at said front strike face of the insert.

11. The method of claim 10, further comprising the steps of:

a) fitting the strike face insert in the strike face cavity with the strike face thereof and the projections of said first insert layer extending beyond the front strike face of said body; and b) machining the front strike face of said insert to expose the projections on the first layer at a location flush with the front strike face of said body.

12. The method of claim 11, comprising the step of:

a) forming said first insert layer of a first opaque colored insert material and said second insert layer of a second opaque colored insert material.

13. The method of claim 12, comprising the step of:

a) forming said first insert layer and said second insert layer of material which is identical in all respects except color.

14. The method of claim 13, comprising the step of:

a) forming said strike face insert of thermoset rubber.

15. The method of claim 14, comprising the step of:

a) forming said strike face insert of a cured mixture comprising a polymer blend, a metal salt of an unsaturated carboxylic acid, a free radical indicator, and silica.

* * * * *

UNITED STATES PATENT AND TRADEMARK OFFICE

CERTIFICATE OF CORRECTION

PATENT NO. : 5,924,939

DATED : July 20, 1999

INVENTOR(S) : Robert M. GRACE et al.

It is certified that error appears in the above-identified patent and that said Letters Patent is hereby corrected as shown below:

In column 2, line 37, delete "indicator" and insert --initiator--.

In Claim 1, column 3, line 22, delete "face" and insert --surface--.

In Claim 8, column 3, line 50, delete "indicator" and insert --initiator--.

In Claim 15, column 4, line 47, delete "indicator" and insert --initiator--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*